US008567226B2

(12) United States Patent
Morales

(10) Patent No.: US 8,567,226 B2
(45) Date of Patent: Oct. 29, 2013

(54) DIE FOR USE IN SHEET METAL FORMING PROCESSES

(75) Inventor: Arianna T. Morales, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1174 days.

(21) Appl. No.: 12/246,492

(22) Filed: Oct. 6, 2008

(65) Prior Publication Data

US 2010/0083728 A1 Apr. 8, 2010

(51) Int. Cl.
*B21D 37/18* (2006.01)
*B21B 45/02* (2006.01)
*B21K 5/20* (2006.01)

(52) U.S. Cl.
USPC ..... 72/412; 72/41; 72/469; 76/107.1

(58) Field of Classification Search
USPC ..... 72/469, 474, 412, 252.5, 199, 350, 414, 72/476; 76/107.1; 492/28, 30
See application file for complete search history.

(56) References Cited

U.S. PATENT DOCUMENTS 2,384,349 A * 9/1945 Sherman ..... 72/469
3,749,021 A 7/1973 Burgess
4,576,872 A 3/1986 Ward
4,617,817 A 10/1986 Gegel et al.
4,762,679 A 8/1988 Gegel et al.
4,978,583 A * 12/1990 Wakui et al. ..... 428/600
5,328,776 A 7/1994 Garber et al.
5,398,572 A 3/1995 Hashimoto et al.
5,509,726 A 4/1996 Overbeck
5,551,151 A 9/1996 Overbeck
5,664,454 A 9/1997 Zeiter et al.
5,745,971 A * 5/1998 Ohsawa et al. ..... 29/421.1
6,235,407 B1 5/2001 Ogata et al.
6,566,635 B1 5/2003 Matsen et al.
6,619,094 B2 * 9/2003 Juhl ..... 72/296
6,745,609 B2 6/2004 Garnett et al.
7,320,832 B2 1/2008 Palumbo et al.
7,621,201 B2 * 11/2009 Hanna ..... 76/107.1
8,069,697 B2 * 12/2011 Kurisu et al. ..... 72/342.3
2001/0022103 A1 9/2001 Zeiter et al.
2004/0129052 A1 7/2004 Krajewski et al.
2010/0009827 A1 * 1/2010 Lee ..... 492/30

* cited by examiner

*Primary Examiner* — Debra Sullivan
(74) *Attorney, Agent, or Firm* — Dierker & Associates, P.C.

(57) ABSTRACT

A die for use in a sheet metal forming process includes a die material having a surface. A plurality of depressions is formed in a predetermined portion of the surface, where each of the plurality of depressions has a predetermined diameter and depth. Interaction of a surface of a sheet metal blank with i) the plurality of depressions, and ii) a solid forming lubricant, including particles of an average predetermined size and distribution, disposed on one of the die material surface or the sheet metal blank surface substantially reduces adhesion between the sheet metal blank surface and the die material surface during the sheet metal forming process.

18 Claims, 1 Drawing Sheet

DIE FOR USE IN SHEET METAL FORMING PROCESSES

TECHNICAL FIELD

The present disclosure relates generally to sheet metal forming processes and, more particularly, to a die for use in sheet metal forming processes.

BACKGROUND

Automotive body panels and other similar articles of manufacture are often made by hot or warm forming a sheet metal blank using a forming press. During the hot and warm forming processes, the sheet metal blank is pressed against the surface of at least one die in the forming press in the presence of heat. After a predetermined amount of pressing time, the sheet metal blank assumes the shape of the die surface and the sheet metal blank is thereafter removed from the forming press. In some instances, the die or the sheet metal blank is coated with relatively large amounts of lubricant to reduce adhesion between the sheet metal blank and the die surface during the forming process.

SUMMARY

As disclosed herein, a die for use in a sheet metal forming process includes a die material having a surface. A plurality of depressions is formed in a predetermined portion of the surface, where each of the plurality of depressions has a predetermined diameter and depth. Interaction of a surface of a sheet metal blank with i) the plurality of depressions, and ii) a solid forming lubricant, including particles of an average predetermined size and distribution, disposed on one of the die material surface or the sheet metal blank surface substantially reduces adhesion between the sheet metal blank surface and the die material surface during the sheet metal forming process.

BRIEF DESCRIPTION OF THE DRAWINGS

Features and advantages the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
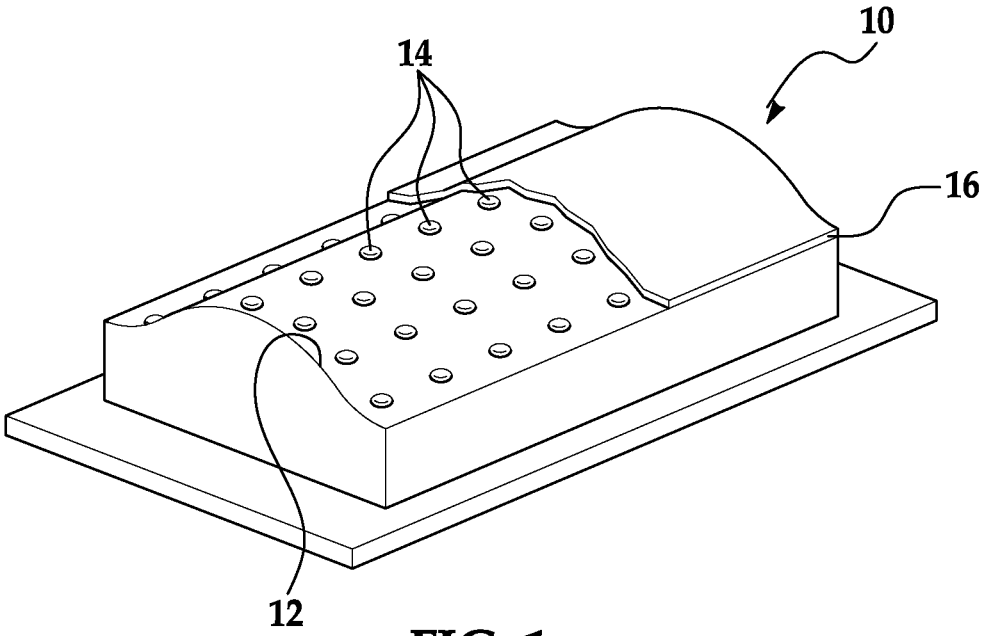
FIG. 1 is a perspective view of an embodiment of a die for use with a forming press during a sheet metal forming process.

Current metal forming processes often employ relatively large amounts of lubricant added to the die surface to reduce adhesion between the die surface and the sheet metal blank. When adhesion results, other deleterious effects (e.g., wear) to the die surface and the sheet metal blank may also result. Generally, adhesion occurs, at least in part, because of the chemical affinity between the material of the die surface and that of the sheet metal blank. Non-limiting examples of sheet metal blank materials that tend to exhibit a chemical affinity to die surface materials include pure aluminum having minimal amounts (e.g., 0.1% or less) of impurities, aluminum alloyed with at least some magnesium, other aluminum alloys, magnesium alloys, or other materials commonly produced in sheet form. When any of these materials are used for the sheet metal blank, and are subjected to heat and pressure during a sheet metal forming process, at least some adhesion may occur between the sheet metal blank and the die surface. As previously mentioned, such adhesion may cause wear and other undesirable effects, which may require the die to be subjected to additional processing in order to restore the die to production quality.

In the embodiment(s) disclosed herein, the die is advantageously configured to substantially reduce or even eliminate the adhesive effects between the sheet metal blank and the die surface during sheet metal forming processes, and especially during warm or hot forming processes. The advantageous reduction in deleterious effects is accomplished without having to apply large amounts of lubricant to the die surface. This is brought about, at least in part, by 1) modifying the surface of the die with a plurality of depressions, and 2) disposing, on either the surface of the die or a surface of the sheet metal blank, a relatively thin layer of a solid forming lubricant. The modified die surface and the lubricant together reduce the coefficient of friction between the sheet metal blank and the die surface, which reduces or even eliminates sticking of the sheet metal blank to the die surface. It is to be understood that the coefficient of friction is a relative measure obtained from a system in which two or more materials (in this case, the sheet metal blank, the die, and the lubricant) are in contact with each other under certain conditions (e.g., pressure, temperature, time, to name a few). Using the process disclosed herein, a significant reduction in the coefficient of friction (when compared to other sheet metal forming processes in which the die(s) do not have a modified surface) may be achieved. In a non-limiting example, a suitable reduction in the coefficient of friction is at least 30%. In another example, the reduction in the coefficient of friction ranges from about 40% to about 50%.

The reduced or eliminated adhesion advantageously 1) facilitates easier removal of the formed sheet metal blank (i.e., an article) from the forming press, 2) reduces the number of surface defects or blemishes of the article, 3) reduces the need for post metal finishing processes on the article due to the reduced number of surface defects or blemishes thereon, 3) extends the working life of the die, and 4) enables a higher quality of article to be formed during sheet metal forming processes.

A perspective view of an embodiment of the die 10 is generally depicted in FIG. 1. The die 10 includes a forming surface 12 having a plurality of depressions 14 formed therein. The depressions 14 may be formed in the die surface 12 via a number of suitable methods including, for example, laser texturing, mechanical forming, water abrasion, or combinations thereof. It is to be understood that the depressions 14 shown in FIG. 1 (as well as those shown in FIG. 2, which will be described in further detail below) are not drawn to scale, and are magnified merely for illustrative purposes.

Figure 2:
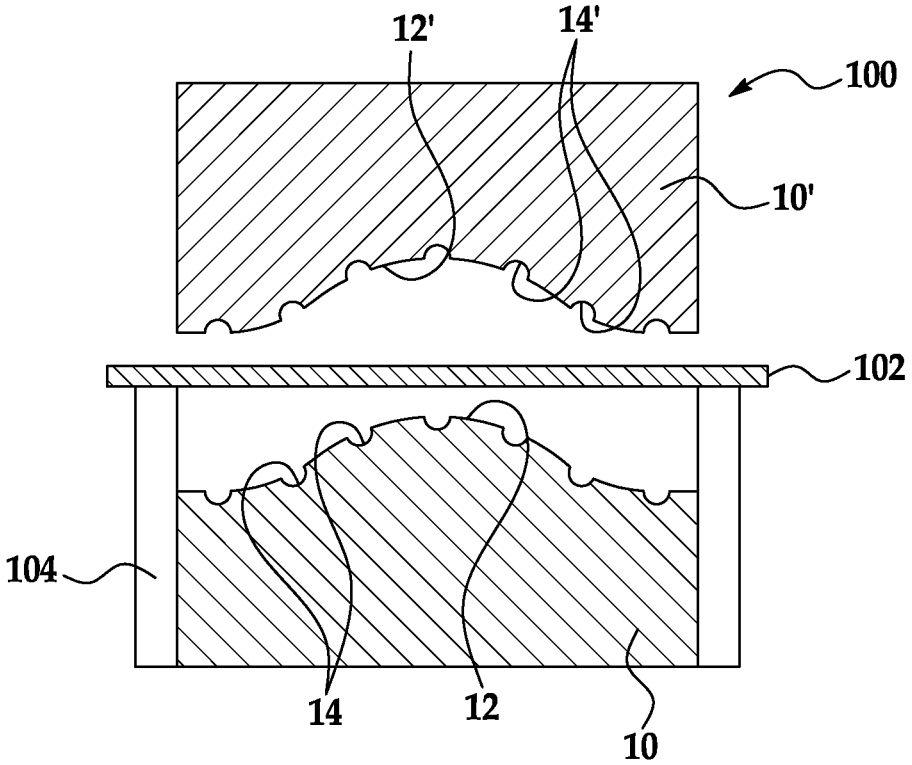
FIG. 2 is a semi-schematic, cross-sectional view of an example of a forming press employing the die shown in FIG. 1.

Without being bound to any theory, it is believed that the distance between adjacent individual depressions 14 formed in the die surface 12, as well as the surface roughness of the die surface 12 in an area where the depressions 14 are formed, affects the coefficient of friction value between the die surface 14 and a sheet metal blank (see reference numeral 102 in FIG. 2). It is to be understood that the sheet metal blank 102 is used for forming an article during a forming process, and will be described in further detail below in conjunction with FIG. 2.

The depressions 14 are formed in predetermined portion(s) of the surface 12. The predetermined portion(s), in terms of density, ranges from about 1% to about 15% of the surface 12. As such, up to 15% of the surface 12 may correspond to depressions 14, while the remainder of the surface 12 remains unmodified. While the percentage of the surface 12 that forms the depressions 14 is relatively small, the depressions 14 may be spread across the entire surface 12 in a desirable arrangement (discussed further hereinbelow).

It is to be understood that the coefficient of friction between the sheet metal blank 102 and the die surface 14 is also affected by the arrangement of the depressions 14 formed on the surface 12. Several different depression arrangements, in addition to different shapes and sizes, may be used. It is believed, however, that a substantially uniform arrangement of the depressions 14 on the die surface 12 (as shown in FIG. 1) may advantageously have a greater impact on achieving the desirable reduction of the coefficient of friction value than other arrangements. In other words, it is believed that the adhesion between the sheet metal blank 102 and the die surface 12 is substantially reduced or eliminated when the treatment used to form the depressions 14 is substantially the same across the entire surface 12.

It is further believed that the coefficient of friction is also affected by the dimensions (i.e., diameter and depth) of the depressions 14. For either warm or hot forming processes, the predetermined diameter of each of the depressions 14 ranges from about 240 μm to about 340 μm, and the predetermined depth of each of the depressions 14 ranges from about 15 μm to about 30 μm.

As such, the size, shape and location of the depressions 14 on the surface 12 may be altered to achieve the desirable reduction in the coefficient of friction. In one non-limiting example, when either a warm or hot forming process is utilized, the depressions 14 correspond to 5% of the die surface 12 (e.g., the entire die surface 12 is treated to form the depressions 14, but the density of the resulting depressions 14 is 5%), where the diameter of each of the depressions 14 is 320 μm and the depth of each of the depressions 14 is 20 μm. This particular combination is believed to achieve a suitable coefficient of friction in order to reduce or eliminate adhesion between the die surface 12 and the sheet metal blank 102 during metal forming.

It is to be further understood that the predetermined portion of the surface 12 which corresponds to the depressions 14 and the positioning of such depressions 14 are selected based on, at least in part, the geometry of the article to be formed from the sheet metal blank 102 during the sheet metal forming process.

In an embodiment, a layer of a solid forming lubricant is applied on the die surface 12 (depicted as reference numeral 16 in FIG. 1) or on the sheet metal blank surface (not shown in the Figures) in a predetermined thickness. It is to be understood that when the lubricant 16 is established on the die surface 12, the depressions 14 may be partially or completely filled with such lubricant 16. Without being bound to any theory, it is believed that the interaction of the modified die surface 12 and the selected solid forming lubricant 16 suitably reduces the coefficient of friction between the sheet metal blank 102 and the surface 12 during the forming process. In an embodiment, the solid forming lubricant 16 is selected from lubricants including particles of an average predetermined size (e.g., average diameter) and particle size distribution. The average predetermined size of the particles in the solid forming lubricant 16 ranges from about 0.5 μm to about 60 μm. In one example, the particle size distribution includes 90% of the particles being finer than (or having a diameter smaller than) about 20 μm. In another example, the particle size distribution includes 90% of the particles being finer than (or having a diameter smaller than) about 10 μm. In still other examples, the particle size distribution includes 50% of the particles being finer than (or having a diameter smaller than) about 10 μm, or the particle size distribution includes 50% of the particles being finer than (or having a diameter smaller than) about 5 μm. In yet another example, the particle size distribution includes 10% of the particles being finer than (or having a diameter smaller than) about 5 μm. Still further, the particle size distribution may include 10% of the particles being finer than (or having a diameter smaller than) about 2 μm. A suitable lubricant includes, but is not limited to a boron nitride (BN) based lubricant, where BN is present in an amount of about 95% and the remaining 5% including one or more additives (e.g., surfactants, etc.).

It is to be understood that the solid forming lubricant layer 16 generally has a thickness that is smaller than the thickness of lubricant layers that are often applied in current metal forming processes. As a non-limiting example, a typical system utilizing a die without surface modifications may require lubricant applied with a thickness of 15 μm, whereas the system disclosed herein utilizing the die 10 with the modified surface 12 may include a lubricant thickness of about 8 or 9 μm. In a non-limiting example, the thickness of the solid forming lubricant layer 16 ranges from about 2 μm to about 20 μm. It is believed that the reduction in lubricant is advantageous, at least in part because the cost associated with sheet metal forming increases when more lubricant is used, the potential for more defects forming on the resulting parts increases when more lubricant is used, and more frequent cleanings are required when more lubricant is used.

FIG. 2 depicts an exemplary forming apparatus (e.g., a forming press) 100 that may be used for forming, via a stamping or other warm forming process, articles of manufacture from sheet metal blanks 102. In the example shown in FIG. 2, the forming press 100 includes an upper die 10' and a lower die 10. It is to be understood that the upper and lower dies 10', 10 are the same as or similar to the die 10 depicted in FIG. 1. It is further to be understood that, in some instances, the forming press may include an upper die 10' without a lower die 10, or a lower die 10 without an upper die 10', and that such configurations are within the spirit and scope of the instant disclosure.

A sheet metal blank 102 is placed between the upper and lower dies 10', 10, and is supported in the forming press 100 by a support member 104 such as, for example, a clamp or other suitable support means. During the warm sheet metal forming processes, at least one of the upper or lower dies 10', 10 is drawn toward the other of the dies 10, 10'. This movement presses the supported sheet metal blank 102 against the surfaces 12', 12 of the dies 10', 10 in the presence of heat. For warm forming processes, the amount of heat applied during the process ranges from about 200° C. to about 350° C.

After a predetermined period of pressing time, the sheet metal blank 102 assumes the shape of the die surfaces 12, 12' and forms the article (not shown). Thereafter, the upper and lower dies 10', 10 are retracted from one another (or one 10', 10 is retracted from the other 10, 10'), and the article is released from the support member 104. The article is then removed from the forming press 100. In a non-limiting example, the predetermined pressing time for a stamping process ranges from about 1.5 seconds to about 3 seconds. In another non-limiting example, the predetermined pressing time for a quick plastic forming or superplastic forming process ranges from about 90 seconds to about 150 seconds, depending at least in part on the complexity of the part to be formed.

For hot forming processes, the temperature of the process ranges from about 400° C. to about 1200° C. Hot forming generally involves superplastic forming process in which the sheet metal blank 102 is deformed against the die cavity by the effect of blown air.

In addition, the dies 10, 10' disclosed herein may also be used with hydroforming (cold or warm), in which the deformation on the sheet 102 is cause by pressure applied by a fluid.

While several embodiments have been described in detail, it will be apparent to those skilled in the art that the disclosed embodiments may be modified. Therefore, the foregoing description is to be considered exemplary rather than limiting.

The invention claimed is:

1. A die for use in a sheet metal forming process, the die comprising:

a die material having a surface; and a plurality of depressions formed in the surface of the die material, the plurality of depressions combined having a density such that the plurality of depressions constitutes from about 1% to about 15% of a total area of the surface of the die material while a remainder of the surface is unmodified, and the plurality of depressions being arranged uniformly across the whole surface of the die material, and each of the plurality of depressions having i) a predetermined diameter, and ii) a predetermined depth ranging from about 15 μm to about 25 μm;

wherein:

the density and the arrangement of the plurality of depressions contribute to a reduction in a coefficient of friction between a sheet metal blank and the die material surface, the reduction of the coefficient of friction being at least 30%; and interaction of a surface of the sheet metal blank with i) the plurality of depressions, and ii) a solid forming lubricant, including particles of an average predetermined size and distribution, disposed on one of the die material surface or the sheet metal blank surface substantially reduces adhesion between the sheet metal blank surface and the die material surface during the sheet metal forming process.

2. The die as defined in claim 1 wherein the predetermined diameter of each of the plurality of depressions ranges from about 300 μm to about 340 μm.

3. The die as defined in claim 1 wherein:

the predetermined diameter of each of the plurality of depressions is about 320 μm;

the predetermined depth of each of the plurality of depressions is about 20 μm; and the plurality of depressions combined constitutes about 5% of the total area of the surface of the die material.

4. The die as defined in claim 1 wherein the predetermined diameter of each of the plurality of depressions, the predetermined depth of each of the plurality of depressions, and a portion of the surface in which the plurality of depressions is formed are selected based on a geometry of an article to be formed during the sheet metal forming process.

5. The die as defined in claim 1 wherein the average predetermined size of the particles in the solid forming lubricant ranges from about 0.5 microns to about 60 microns.

6. A system for forming an article, comprising:

a die having a plurality of depressions formed in a surface thereof, the plurality of depressions being uniformly arranged across the whole surface of the die, and the plurality of depressions having a density such that the plurality of depressions combined constitutes from about 1% to about 15% of a total area of the surface of the die while a remainder of the surface is unmodified, each of the plurality of depressions having i) a predetermined diameter, and ii) a predetermined depth ranging from about 15 μm to about 25 μm;

a sheet meal blank having a surface positioned to contact the die; and a solid forming lubricant disposed on one of the die surface or the sheet metal blank surface, the solid forming lubricant including particles of an average predetermined size and distribution;

wherein:

the density and the arrangement of the plurality of depressions contribute to a reduction in a coefficient of friction between the sheet metal blank and the die surface, the reduction in the coefficient of friction being at least 30%; and interaction of the sheet metal blank surface with i) the plurality of depressions, and ii) the solid forming lubricant substantially reduces adhesion between the sheet metal blank surface and the die during a sheet metal forming process.

7. The system as defined in claim 6 wherein the lubricant has a thickness ranging from about 2 μm to about 20 μm.

8. The system as defined in claim 7 wherein the lubricant has a thickness of about 8 μm or about 9 μm.

9. The system as defined in claim 6, further comprising an other die positioned to contact an other surface of the sheet metal blank, the other die having a plurality of depressions formed in a predetermined portion of a surface thereof, each of the plurality of depressions having a predetermined diameter and depth.

10. A method of making a die for use in a sheet metal forming process, the method comprising:

providing a die material having a surface; and forming a plurality of depressions arranged uniformly across the whole surface of the die material, the plurality of depressions having a density such that the plurality of depressions combined constitutes from about 1% to about 15% of a total area of the surface of the die material while a remainder of the surface is unmodified, and each of the plurality of depressions having i) a predetermined diameter and ii) a predetermined depth ranging from about 15 μm to about 25 μm;

wherein:

the density and the arrangement of the plurality of depressions contribute to a reduction in a coefficient of friction between a sheet metal blank and the die material surface, the reduction in the coefficient of friction being at least 30%; and interaction of a surface of the sheet metal blank with i) the plurality of depressions, and ii) a solid forming lubricant, including particles of an average predetermined size and distribution, disposed on one of the die material surface or the sheet metal blank surface substantially reduces adhesion between the sheet metal blank surface and the die material surface during the sheet metal forming process.

11. The method as defined in claim 10 wherein forming the plurality of depressions is accomplished by laser texturing, mechanical forming, water abrasion, and combinations thereof.

12. The method as defined in claim 10 wherein during the sheet metal forming process, the die material surface, modified with the plurality of depressions, substantially reduces the coefficient of friction between the sheet metal blank surface and the die material surface.

13. A method of forming an article from a workpiece, the method comprising:

placing the workpiece in a forming apparatus, the forming apparatus including at least one die having a surface, from about 1% to about 15% of a total area of the surface being modified with a plurality of depressions arranged uniformly across the whole surface of the at least one die while a remainder of the surface is unmodified, and each of the plurality of depressions has i) a predetermined diameter and ii) a predetermined depth ranging from about 15 μm to about 25 μm;

establishing a solid forming lubricant, including particles of an average predetermined size and distribution, on the modified die surface or on a surface of the workpiece that contacts the modified die surface;

forming the article by pressing the workpiece against the modified surface of the at least one die, wherein during the forming, the plurality of depressions and the lubricant interact with the surface of the workpiece to substantially reduce a coefficient of friction between the workpiece and the modified die surface, the coefficient of friction being reduced by at least 30%; and removing the workpiece from the forming apparatus without the workpiece adhering to the modified die surface.

14. The method as defined in claim 13 wherein:

the predetermined diameter of each of the plurality of depressions ranges from about 300 μm to about 340 μm; and the plurality of depressions combined constitutes from about 1% to about 10% of a total area of the surface of the at least one die.

15. The method as defined in claim 13 wherein forming the article is accomplished by hot forming where a temperature ranges from about 400° C. to about 1200° C., or warm forming where a temperature ranges from about 200° C. to about 350° C.

16. The method as defined in claim 13 wherein the average predetermined size of the particles in the solid forming lubricant ranges from about 0.5 microns to about 60 microns.

17. The method as defined in claim 13 wherein the lubricant has a thickness ranging from about 2 μm to about 20 μm.

18. The method as defined in claim 17 wherein the lubricant has a thickness of about 8 μm or about 9 μm.

* * * * *